United States Patent [19]

Hirano et al.

[11] Patent Number: 4,573,880

[45] Date of Patent: Mar. 4, 1986

[54] HERMETICALLY SEALED MOTOR COMPRESSOR

[75] Inventors: Yutaka Hirano; Hirokazu Kawakami, both of Ota; Masaaki Tanaami, Oramachi; Motohiko Kosano; Hiroshi Takagi, both of Isezaki; Yoshio Ishiai, Ota; Ituo Iwahashi, Chiyodamachi, all of Japan

[73] Assignees: Sanyo Electric Co., Ltd., Osaka; Tokyo Sanyo Electric Co., Ltd., Gunma, both of Japan

[21] Appl. No.: 707,187

[22] Filed: Mar. 4, 1985

Related U.S. Application Data

[63] Continuation of Ser. No. 442,138, Nov. 16, 1982, abandoned.

[30] Foreign Application Priority Data

Sep. 2, 1982 [JP] Japan ..... 57-153723
Sep. 2, 1982 [JP] Japan ..... 57-153725

[51] Int. Cl.[4] ..... F04B 39/00

[52] U.S. Cl. ..... 417/312; 181/403; 417/902

[58] Field of Search ..... 417/902, 312, 363, 424, 417/540-544; 181/403; 62/296

[56] References Cited

U.S. PATENT DOCUMENTS

| | | | |
|---|---|---|---|
| 3,396,907 | 8/1968 | Valbjorn | 417/312 |
| 3,514,225 | 5/1970 | Monden et al. | 417/902 X |
| 3,544,240 | 12/1970 | Rundell | 417/902 X |
| 3,664,769 | 5/1972 | Knudsen et al. | 417/902 X |
| 3,679,333 | 7/1972 | Zoppi | 417/571 |
| 4,115,035 | 9/1978 | Tankred et al. | 417/902 X |
| 4,313,715 | 2/1982 | Richardson | 417/312 |
| 4,345,882 | 8/1982 | Saito et al. | 417/902 X |
| 4,370,104 | 1/1983 | Nelson et al. | 417/902 X |

FOREIGN PATENT DOCUMENTS

| | | | |
|---|---|---|---|
| 40263 | 3/1980 | Japan | 417/312 |
| 109786 | 8/1980 | Japan | 417/312 |

*Primary Examiner*—Edward K. Look
*Attorney, Agent, or Firm*—Stiefel, Gross, Kurland & Pavane

[57] ABSTRACT

A hermetically sealed motor compressor for use in a small-size refrigerating machine, refrigerator, freezer and the like has a compressor on which is mounted a silencer comprising in combination a suction muffler of thermal insulating and a discharge muffler made of formed metal plates. The suction muffler has an suction port disposed near the open end of a suction coupling fixed to a sealed casing, and also has an connection pipe connected to a compressor cylinder and having a distal end fitted directly in a hole defined in an head plate which is mounted on the head of the cylinder. A refrigerant gas as it is introduced from the suction coupling into the sealed casing can be drawn into the cylinder through the suction port, the suction muffler and the connection pipe to minimize heat transfer to the suction gas, so that the compressor can increase its volumetric efficiency.

10 Claims, 5 Drawing Figures

HERMETICALLY SEALED MOTOR COMPRESSOR

This is a continuation of application Ser. No. 442,138, filed Nov. 16, 1982 now abandoned.

TECHNICAL FIELD

The present invention relates to hermetically sealed motor compressor for a mechanical refrigeration system and the like, and more particularly to an improved muffler construction of the compressor unit within the hermetically sealed casing.

BACKGROUND OF THE INVENTION

The hermetically sealed motor compressor comprises, in general, a motor compressor unit including a motor assembly mounted with a frame and a sealed housing within which the motor compressor is supported by means of a plurality of coil springs each having one end connected with the frame and the other end connected with the interior of the housing. An inlet coupling is fixed to the wall of the sealed casing for introducing a low-temperature refrigerant gas into the sealed casing, and a discharge outlet coupling is fixed to the wall of the casing which is coupled to the discharge muffler through a tubular conduit. And, as the discharge gas is relatively hot due to the compression process, it is generally desirable to minimize heat transfer to the suction gas so as to maintain a high volumetric efficiency.

The volumetric efficiency of the compressor is the actual volume of gas pumped divided by the calculated cylinder volume, and several factors affect the volumetric efficiency. One factor which affects the actual volumetric efficiency, under the condition that the high side pressure and low side pressure of the compressor are maintained constant, is the temperature of the gas to be suctioned to the cylinder. The density of high temperature gas is low so that, when the cylinder is filled by the high temperature gas, very small amount, by weight, is represented, and reduces the actual pumping capacity.

A variety of attempts have been made to meet the foregoing requirement. According to certain proposals, the outlet of the suction coupling extending through and secured to the wall of the sealed casing is located as closely as possible to the suction port of suction muffler, or joined to the suction port so that the refrigerant gas will be introduced from the suction coupling into the suction muffler to minimize heat conduction in the sealed casing (see U.S. Pat. No. 4,242,056) with another prior art the suction muffler and discharge muffler are disposed separately from the cylinder, to prevent the refrigerant gas from being heated in the suction process to the cylinder (see U.S. Pat. Nos. 3,411,705, 3,480,206 and 3,600,110). These arrangements are not so effective for attaining high volumetric efficiency because the suction gas led into suction chamber is warmed by the heated discharge gas. In the previous compressor, a cylinder head is mounted on the top of the valve plate and contains the suction chamber and the discharge chamber, which are separated by means of the cross wall. As the discharge chamber is warmed to a relatively higher temperature by the hot refrigerant gas discharged out of the cylinder due to the refrigerant compression process, and the low temperature refrigerant gas introduced from the suction coupling into the suction muffler and led into an suction chamber is warmed and draw into the cylinder, the conventional cylinder head is less effective for volumetric efficiency and therefore the compressor can not attain the high efficiency.

The refrigerant gas as it is compressed in the cylinder is discharged through the discharge chamber in the cylinder head into the discharge muffler. The discharge muffler is generally mounted on the cylinder head attached in covering relation to an end face of the cylinder (see U.S. Pat. No. 3,698,840). Where the sealed casing is spherical in shape for better noise suppresion, an upper end of the cylinder head tends to interfere with an inner wall surface of the sealed casing, a disadvantage which can only be eliminated by increasing the size of the sealed casing for providing a desired hermetically sealed motor compressor.

SUMMARY OF THE INVENTION

The present invention provides a hermetically sealed motor compressor, comprising a casing for receiving a refrigerant gas through a suction coupling, a motor and a compressor having a piston and cylinder, said motor and compressor being resiliently mounted in said casing, a head plate mounted on the head of said cylinder having a suction hole and a discharge hole, or a valve plate mounted on the head of said cylinder having a suction hole, a suction valving, a discharge hole and a discharge valving, a suction muffler made of a thermal insulating material having a suction port and a connection pipe, said suction port being disposed near the open end of said suction coupling, said connection pipe being disposed between said suction muffler and said head plate or valve plate directly connected to said cylinder through the suction hole of said head plate or valve plate.

According to the present invention, a refrigerant gas as it is introduced from the suction coupling into the sealed casing is led directly into an top end of the compressor cylinder through the suction muffler at a low temperature to minimize the influence of the heated circumstances in the sealed casing, thus increasing the refrigerating capacity of the hermetically sealed motor compressor.

The discharge muffler is comprised of a stamped-out metal plate and a sheet metal shaped member which are welded around their peripheral flange, an arrangement which can be fabricated easily and economically.

Even where the sealed casing is spherically shaped for better noise reduction characteristics, there is no need to increase the size of the casing as the discharge muffler does not interfere with the casing, and hence the hermetically sealed motor compressor is rendered smaller in size and spherical in shape.

DESCRIPTION OF THE PREFERRED EMBODIMENTS

Figure 1:
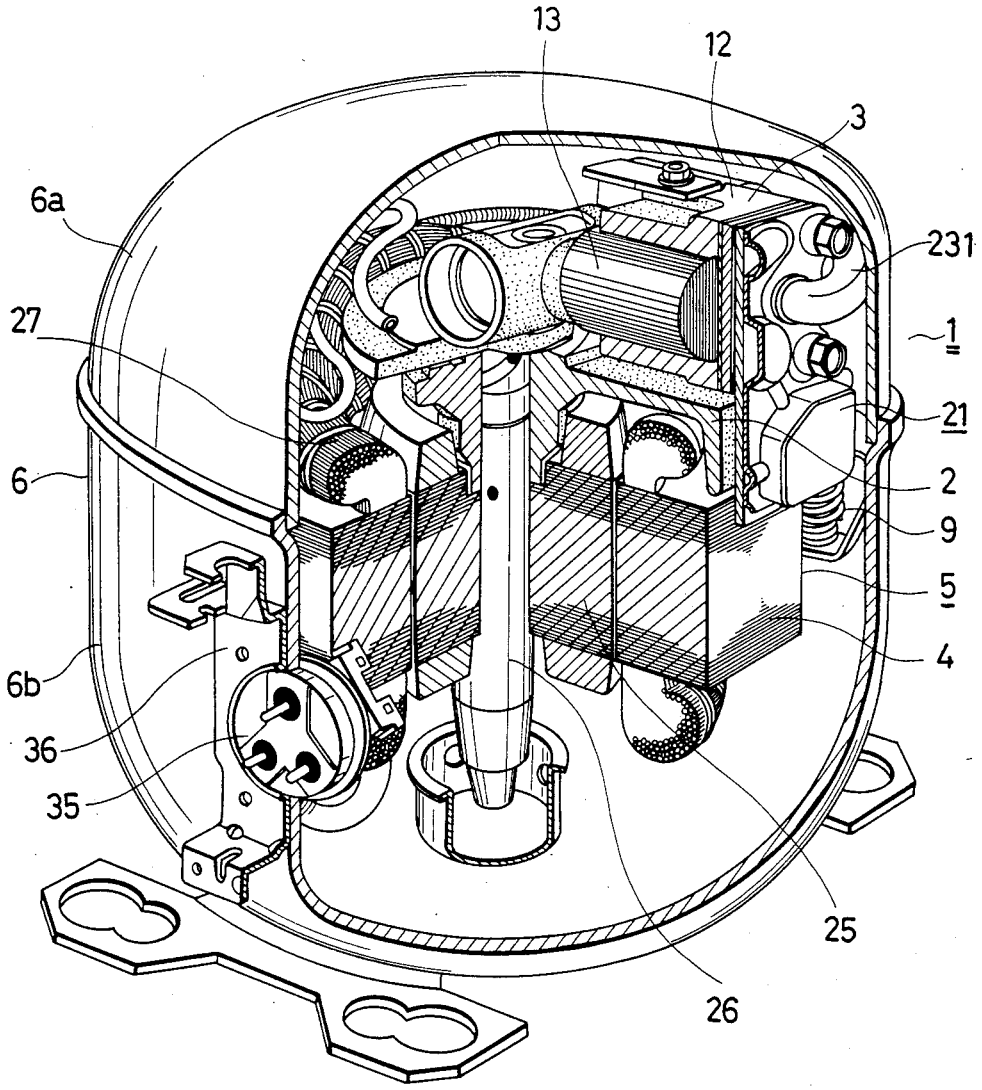
FIG. 1 is a perspective view, with parts cut away, of a hermetically sealed motor compressor according to the present invention.

The present invention will hereinafter be described with reference to the drawings which show an embodiment of the invention.

A hermetically sealed motor compressor 1 according to the present invention comprises a combination 5 of a compressor 3 and a motor 4 which are assembled together and disposed upwardly and downwardly, respectively, of a frame 2 having a pair of support legs 2*b*, 2*c*. The motor and compressor combination 5 is resiliently supported by three coil springs 7, 8, 9 in a hermetically sealed casing 6 of substantially spherical configuration comprised of an upper cap 6*a* and a lower cap 6*b*.

The compressor 3 comprises a cylinder 12 fixed to the frame 2 by two bolts 10, 11, a scotch-yoke-driven piston 13 slidably disposed in the cylinder 12, and a valve plate assembly 13 attached to an open end face 12*a* of the cylinder 12 to close the open end and composed of a suction valve 14 for opening and closing a suction hole 13*a* and a discharge valve 15 for opening and closing a discharge hole 13*b*. The compressor 3 also has a discharge muffler 21 comprising a stamped-out plate 211 mounted by bolts 17, 18, 19, 20 on the valve plate assembly 13 with a gasket 16 interposed therebetween in covering relation to the open end face 12*a* of the cylinder 12, and a suction muffler 23 made of thermally insulating material and mounted on the cylinder 12 by a bolt 22, the suction muffler 23 having a substantially U-shaped connection pipe 231 fitted in the suction hole 213 of the stamped-out plate 211 and/or a suction hole 13*d* of the valve plate 13.

The motor 4 generally comprisies a stator 24, a rotor 25, and a rotatable shaft 26 extending through the rotor 25 and journalled in a bearing 2*a* in the frame 2 for driving the compressor 3. The stator 24 has an upper coil end 27 including a lower side 27*a* and a higher side 27*b*. The frame 2 and the compressor 3 are mounted on the stator 24 at lower side 27*a* of the upper coil end 27 thereby to reduce the height of the motor and compressor combination 5, as shown in FIG. 1. An arcuate support plate 28 is disposed on the stator 24 in surrounding relation to the higher side 27*b* of the upper coil end 27, the support plate 28 having a support leg 28*a*. The coil springs 7, 8, 9 have upper ends fitted over the support legs 28*a*, 2*b* 2*c*, respectively, with bushings 29, 30, 31 of synthetic resin interposed therebetween, and lower ends fitted respectively over three retainers 32, 33, 34 mounted in the lower cap 6*b*. Thus, the motor and compressor combination 5 is supported in the casing 6 at three points.

Figure 2:
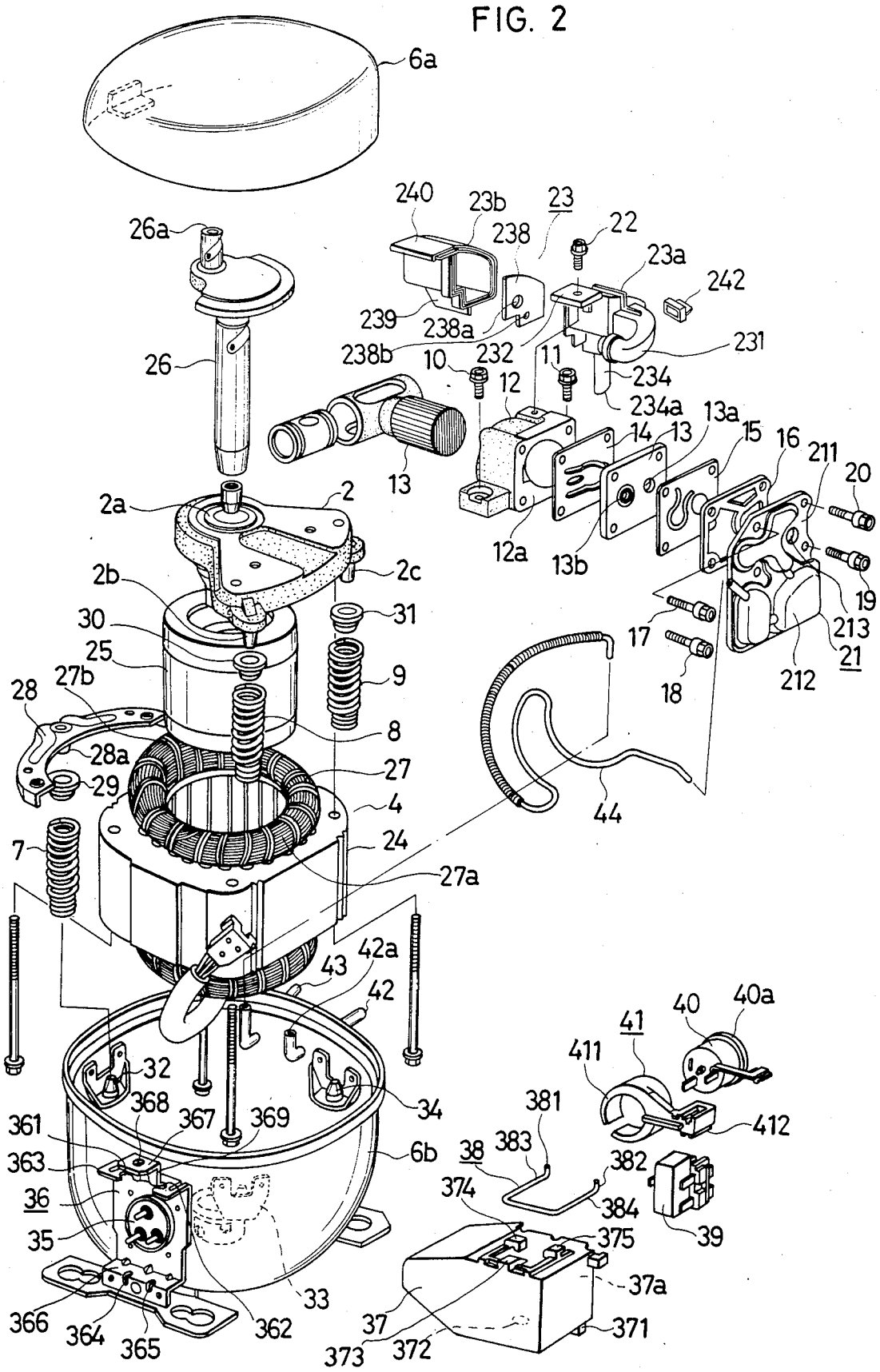
FIG. 2 is an exploded perspective view of the hermetically sealed motor compressor shown in FIG. 1.

As shown in FIG. 2, a pair of suction and discharge coupling 42, 43 are attached to the lower cap 6*b* of the casing 6. The lower cap 6*b* has a hermetic terminal 35 surrounded by a terminal fence 36 attached to an outer surface of the lower cap 6*b*. The terminal fence 36 is formed of a bent plate of metal including an upper bracket 363 having slots 361, 362, a lower bracket 366 having locking holes 364, 365, and an extension hook 369 in its wall 367. A terminal cover 37 integrally molded of synthetic resin has an opening 37*a* in an end face thereof and includes a pair of locking projections 371, 372 disposed below the opening 37*a* and engageable respectively in the locking holes 364, 365 in the terminal fence 36 and three protrusions 374, 375 on an upper face of the terminal cover 37. A U-shaped wire spring 38 is fittingly retained by the protrusions 373, 374, 375 and has bent ends 381, 382 elastically deformed by the protrusions 374, 375 toward each other and fitted respectively in the slots 361, 362. A starter relay 39, which has a thermistor of a positive temperature coefficient (not shown), is fittingly mountable on the hermetic terminal 35. An overload relay 30 has a flange 40*a* and is mounted in an annular member 412 mounted on the starter relay 39.

Figure 3:
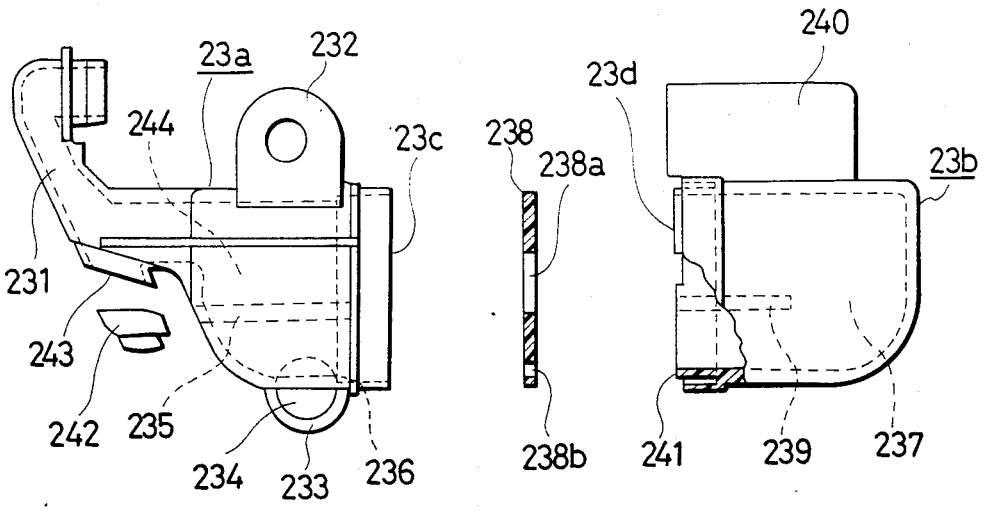
FIG. 3 is an exploded plan view, partly broken away, of a suction muffler in the hermetically sealed motor compressor of FIG. 2.
Figure 4:
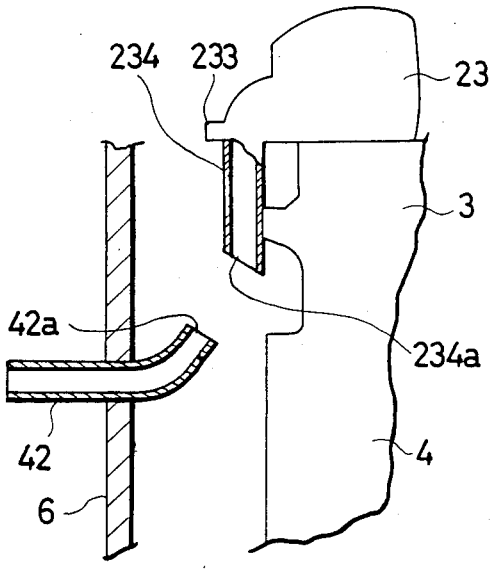
FIG. 4 is a fragmentary vertical cross-sectional view of a portion of the hermetically sealed motor compressor illustrated in FIG. 1.
Figure 5:
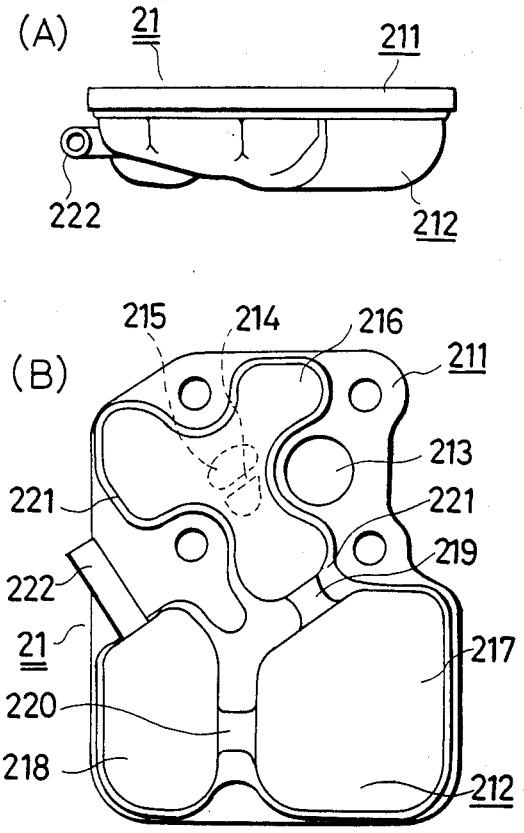
FIGS. 5(A) and 5(B) are plan and front elevational views, respectively, of a discharge muffler in the hermetically sealed motor compressor shown in FIG. 2.

The suction muffler 23 mounted on the compressor 3 is composed of first and second housings 23*a*, 23*b* separated by a plane extending normally to an axis of the U-shaped connection pipe 231. As shown in FIG. 3, the first housing 23*a* which is integrally molded includes the U-shaped connection pipe 231, an expansion chamber 244, a bracket 232 for attachment to the cylinder 12, an suction port 234 having a flange 233 on its proximal end, and an oil fence 235 for preventing oil as ejected from an oil feed hole 26*a* in an end of the shaft 26 from being drawn into the suction port 234. The first housing 23*a* also has a ridge 236 in an opening 23*c* thereof. A separate partition plate 238 is positioned in the ridge 236 and has a communication hole 238*a* and an oil hole 238*b* for discharging oil from the silence chamber 237, the partition plate 238 defining a resonance chamber silencer 237 in the second housing 23*b* has oil fences 239, 240, and an opening 23*d* defined by a double-walled construction including a slot in which an edge bounding the opening 23*c* of the first housing 23*a*, the double-walled construction having an inner wall 241 which serves to retain the partition plate 238 disposed in the step 236 in the first housing 23*a*. A cap 242 closes off an aperture 243 receptive of a jig pin for defining the U-shaped connection pipe 231. The suction port 234 of the first housing 23*a* has an open end 234*a* bevelled parallel to an outlet 42*a* of the suction coupling 42 to allow a refrigerant gas to flow smoothly, as shown in FIG. 4. The open end 234*a* of the suction port 234 and the outlet 42*a* of the suction coupling 42 are spaced by some distance sufficiently small to enable the suction muffler 23 to draw in the refrigerant gas highly efficiently. The suction port 234 is spaced from the casing 6 long enough to prevent resonance due to pulsating sounds given off when drawing in the refrigerant gas, and the end of the suction coupling 42 projects into the casing 6 short enough to prevent the suction coupling 42 from hitting the motor 4. The first and second housings 23*a*, 23*b* are interfitted at their openings 23*c*, 23*d* and coupled together as by an adhesive, with the partition plate 238 defining the silence chamber 237 in the second housing 23*b*.

The discharge muffler 21 also comprises a dish shaped member 212 integrally formed by drawing and brazed or welded to the stamped-out metal plate 211. The stamped-out metal 211 has a hole 215 bridged by limiting element 214 serving as an abutment against over bending of the discharge valve 15. The dish shaped member 212 has a discharge valve chamber 216 and two sound reducing chambers 217, 218 throat passages 219, 220 providing communication between said discharge valve chamber 216 and sound reducing chamber 217, 218 and a peripheral flange 221 held against the stamped-out metal plate 211. With the integral passages 219, 220, it is not necessary to provide such passages separately as in the conventional construction. The flange 221 has a relatively wide, flat surface which enables the dish shaped member 212 to be brazed or welded to the stamped-out metal plate 211 with an increased bonding strength. A pipe 222 extends from the silencer chamber 218 coupled to a discharge conduit 44 and the discharge coupling 43 fixed to the lower cap 6*b* of the casing 6, for discharging the refrigerant gas from the compressor to the refrigeration cycle.

The hermetically sealed motor compressor 1 according to the present invention is suitable for use in a small-size refrigerating machine, air conditioner, a refrigerator, a freezer and the like. The motor and compressor combination 5 with the compressor 3 above the frame 2 and the motor 4 below the frame 2 is resiliently supported by the springs 7, 8, 9 within the substantially spherical sealed casing 6. The suction muffler 23 of thermal insulating material and the discharge muffler 21 composed of formed stamped-out metal plate and dish shaped member are mounted on the compressor 3. The casing 6 has the suction coupling 42 extending through and fixed to the wall of the casing 6. The suction port 234 of the suction muffler 23 extends in confronting relation to the outlet 42*a* of the suction coupling 42 and has the connection pipe 231 with its distal end fitted in the suction hole 213 in the stamped-out metal plate 211 and/or the valve plate 13 which closes off the open end face 12*a* of the cylinder 12 of the compressor 3. A low-temperature refrigerant gas as introduced through the suction coupling 42 into the casing 6 can be led into the clyinder 12 minimizing thermal influence. The refrigerant gas in the suction muffler 23 is thermally insulated and kept at a low temperature as the suction muffler 23 is made of thermal insulating mateial such as synthetic resin having increased thermal insulation capability. The refrigerant gas is delivered from the suction muffler 23 through the connection pipe 231 directly into the cylinder 12. Accordingly, the low-temperature refrigerant gas can be introduced from the suction coupling 42 to the cylinder 12, in which the low-temperature refrigerant gas is compressed. The amount of the refrigerant gas as it circulates is thus increased, resulting in a higher efficiency of the hermetically sealed motor compressor. The discharge muffler 21 is of a simple construction as it is composed only of the stamped-out metal plate 211 and the dish shaped member 212 by drawing or press working which are brazed to each other. The discharge muffler 21 is attached by the valve (seat) plate 13 and the gasket 16 to the open end face 12*a* of the cylinder 12, a construction which is of a thinner dimension than would be the case with the conventional cylinder head used. Even with the sealed casing 6 being substantially spherically shaped for better noise reduction characteristics, there is no danger for the discharge muffler 21 to strike the inner wall surface of the casing 6. The casing 6 can therefore be substantially spherical in shape and small in size, with the result that the hermetically sealed motor compressor 1 is of a small size and produces low noise.

The thermal insulating material that can be used for the suction muffler should preferably be polybutylene terephthalate resin, polyethylene terephthalate resin or polyphenylene sulfide being particularly preferable. The head plates having the discharge muffler is made of iron, having a thickness for example about 3.2 mm.

What is claimed is:

1. A hermetically sealed motor compressor having high volumetric efficiency, said compressor comprising:

a casing including a suction coupling having an open end within said casing, a compressor mounted in said casing, including a cylinder and a piston reciprocatingly slidable in said cylinder, said cylinder including a head plate with a suction hole and a discharge hole, said head plate comprising a stamped out metal plate and a valve plate, said cylinder further including a dish-shaped member attached to the stamped out metal plate and defining therewith a discharge valve chamber, said dish-shaped member being configured to cover said discharge hole without covering said suction hole, a suction muffler formed of a material having a low coefficient of thermal conductivity, the suction muffler having a suction port, said suction port being in close spaced relation to the open end of said suction coupling for drawing said refrigerant gas into said suction muffler, and a connection pipe formed of a material having a low coefficient of thermal conductivity, said connection pipe directly connecting said suction muffler to said cylinder through said suction hole of said head plate for transmitting said refrigerant gas from said suction muffler directly to said cylinder, said connection pipe having a distal end, the distal end being inserted into said suction hole of said head plate, said distal end having no contact with said dish-shaped member, thereby avoiding heat transfer from hot compressed refrigerant gas in said cylinder and dish-shaped member to said refrigerant gas in said connection pipe for improving the volumetric efficiency of said motor compressor.

2. A hermetically sealed motor compressor according to claim 1, wherein said discharge hole of said head plate has a discharge valve in said discharge hole and a limiting element against over bending of said discharge valve.

3. A hermetically sealed motor compressor according to claim 1, wherein said dish shaped member comprises a single sheet metal shaped part and further defines a shallow sound reducing chamber connected to said discharge valve chamber, said dish shaped member having flanges.

4. A hermetically sealed motor compressor according to claim 1, wherein said connection pipe is substantially U-shaped.

5. A hermetically sealed motor compressor according to claim 1, wherein said suction muffler has an expansion chamber therein.

6. A hermetically sealed motor compressor according to claim 5, wherein said expansion chamber has a partition plate dividing said chamber and defining two silencer chambers therein.

7. A hermetically sealed motor compressor according to claim 1, wherein said casing comprises a semispherical upper casing and a semispherical lower casing.

8. The hermetically sealed motor compressor according to claim 1, wherein the material having a low coefficient of thermal conductivity is a synthetic resin.

9. The hermetically sealed motor compressor according to claim 1, wherein said suction muffler and connection pipe are integrally formed.

10. The hermetically sealed motor compressor according to claim 9, wherein the suction muffler has a bracket portion integrally formed therewith for securing the suction muffler and connection pipe to the cylinder.

* * * * *